United States Patent [19]

Reeves, Jr.

[11] Patent Number: 4,932,145

[45] Date of Patent: Jun. 12, 1990

[54] EXCAVATING TOOTH POINT AND ADAPTER ASSEMBLY WITH ADDITIONAL WEAR PREVENTION ELEMENTS

[76] Inventor: James B. Reeves, Jr., 1315 Whitman Dr., Glen Burnie, Md. 21061

[21] Appl. No.: 326,789

[22] Filed: Mar. 21, 1989

[51] Int. Cl.[5] ..... E02F 9/28

[52] U.S. Cl. ..... 37/141 T; 37/142 R; 37/DIG. 19

[58] Field of Search ..... 37/141 T, 142 R, 141 R, 37/DIG. 19

[56] References Cited

U.S. PATENT DOCUMENTS

| | | | |
|---|---|---|---|
| 2,390,611 | 12/1945 | Nixon | 37/141 R |
| 3,462,861 | 8/1969 | Kampert | 37/142 R |
| 3,621,594 | 11/1971 | Hahn et al. | 37/141 T |
| 3,851,413 | 12/1974 | Lukavich | 37/141 T |
| 4,027,408 | 6/1977 | Ramella et al. | 37/141 T |

*Primary Examiner*—Randolph A. Reese
*Assistant Examiner*—Arlen L. Olsen
*Attorney, Agent, or Firm*—Fay, Sharpe, Beall, Fagan, Minnich & McKee

[57] ABSTRACT

A tooth point and adapter assembly has an adapter that is mounted to the bucket of an excavation apparatus and a tooth point that is mounted to the adapter. The tooth point has a cavity having a curved bottom wall and the adapter has a pointed end having a curved bottom wall. Within the tooth point cavity is a protrusion that is adapted to fit within a groove in the top surface of the adapter. Accordingly, the adapter supports the tooth point along its top edge by engagement between the protrusion and groove and the tooth point is supported with full contact between the adapter and tooth point along the curved bottom walls of the adapter and tooth point respectively. The tooth point further includes an indentation in the outer portion of the cavity side wall that matches the profile of the adapter pointed end. Thus, the extent of wear to the tooth point in relation to the adapter can be determined by visual inspection to prevent the tooth point from wearing through and damaging the adapter. Additional wear prevention elements are provided to protect the surfaces of an excavation apparatus bucket that are subject to wear. Shrouds that extend between the tooth points, along the vertical and horizontal corners are included. Also, bucket bottom wear plates and bucket interior liners are provided to fully protect the wear surfaces of the bucket of an excavation apparatus when it is intended that the bucket is to be subjected to extreme abrasion.

21 Claims, 5 Drawing Sheets

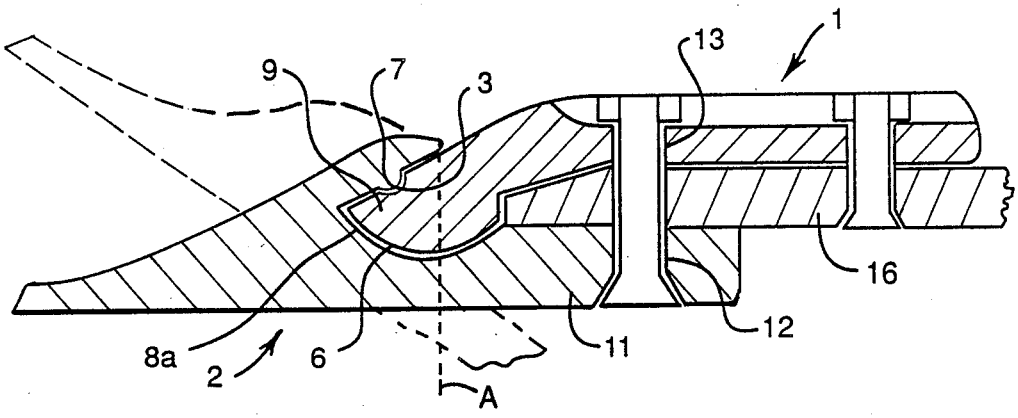
FIG. 3
FIG. 13
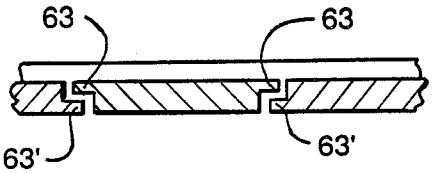
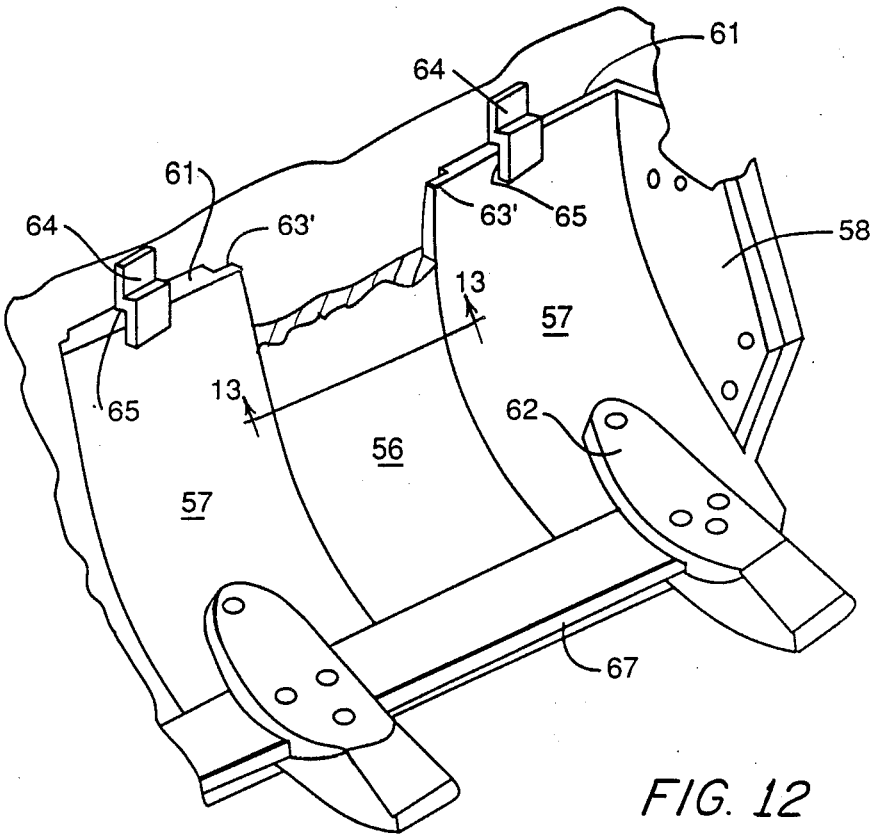
FIG. 12

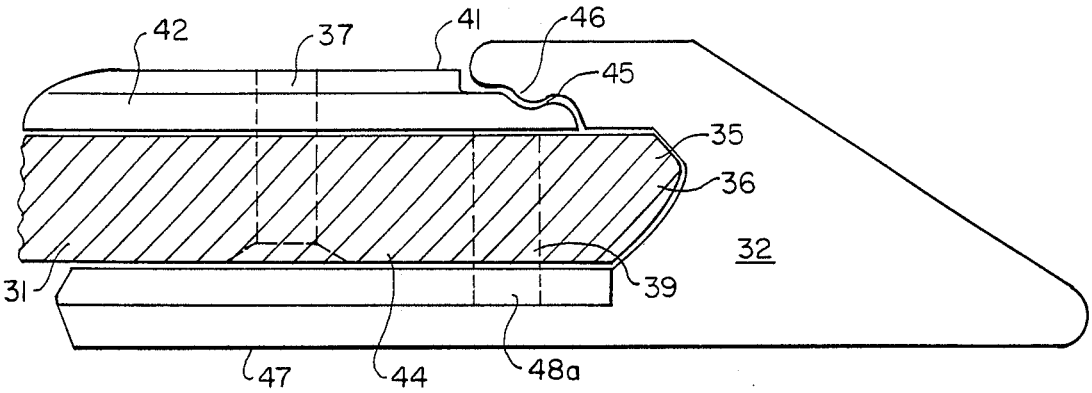
FIG. 8
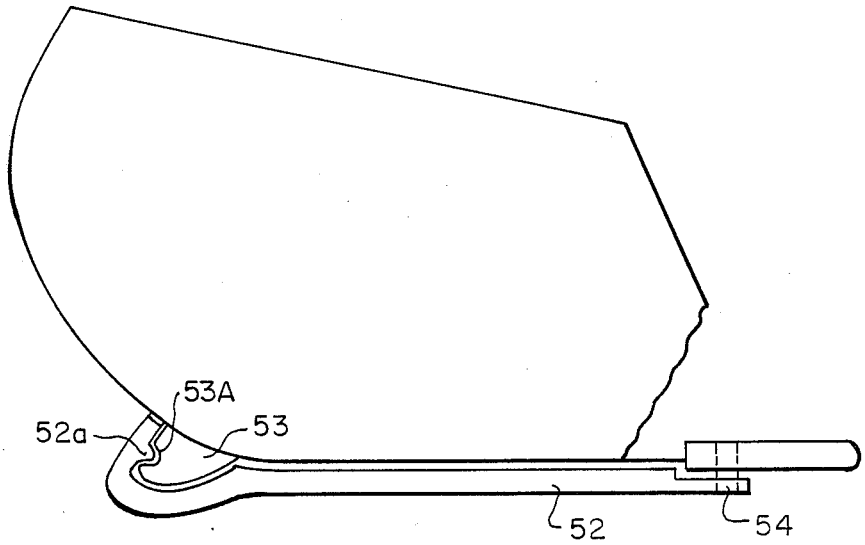
FIG. 9
FIG. 10
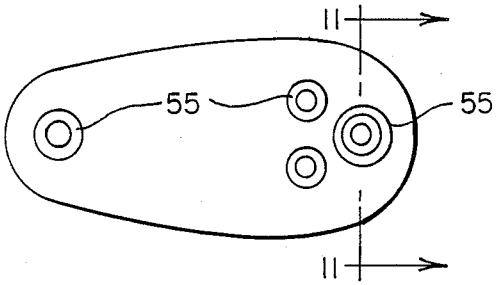
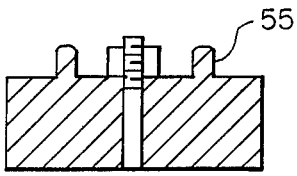
FIG. 11

EXCAVATING TOOTH POINT AND ADAPTER ASSEMBLY WITH ADDITIONAL WEAR PREVENTION ELEMENTS

FIELD OF THE INVENTION

The invention relates to a tooth point and adapter assembly for an excavation bucket loader, for example. The invention also includes additional wear prevention elements including bucket bottom wear plates, bucket liners, and bucket blade and corner shrouds.

BACKGROUND OF THE INVENTION

In all types of excavation equipment, buckets having teeth along the front edge of the bucket are employed for digging, scraping, and shoveling earth and ore. Accordingly, the bucket teeth, which are spaced along the front edge of the bucket, are subject to wear and must be replaced. The front edge of the bucket between the teeth, the bottom of the bucket, the interior of the bucket, the sides and the corners of the bucket are also subject to wear. Usually, the bucket teeth, which are individually known as tooth points, are replaced when excessively worn. On the other hand, if a bucket bottom, sides or the like are worn down through wear, the bucket is replaced or repaired by welding plate metal to the worn area.

A tooth point is normally mounted to the bucket by coupling it to an adapter that is mounted to the bucket. In this way, each tooth is an assembly of a tooth point and an adapter. Accordingly, as the tooth point is worn down, the tooth point can be replaced without having to replace the adapter. Examples of tooth point and adapter assemblies for excavation bucket teeth are shown in U.S. Pat. Nos. 3,462,861; 3,621,594; 3,851,413; and 4,027,408. In addition, U.S. Pat. Nos. 3,621,594 and 3,851,413 disclose wear prevention shrouds that fit between the teeth to protect the front edge and adjacent top and bottom areas of the bucket from being worn.

The teeth must be securely fastened to the bucket. In this regard, the connection between each tooth point and adapter needs to be able to withstand the high stress placed on the connection during excavating operations. The extent of wear occurring to the tooth point and on the bucket is dependent upon the material being excavated. If the material being excavated is highly abrasive, then the wear to the tooth point and bucket will be excessive and the tooth point will have to be replaced more frequently than if the material being excavated is less abrasive. When the tooth points must be replaced frequently, a problem occurs wherein the manner of securely mounting the tooth point to the adapter or bucket prevents the tooth point from being easily replaced. For example, in U.S. Pat. No. 3,462,861, the tooth point is mounted to the adapter by an interfitting groove and projection along an upper portion of the adapter and a shim driven between the tooth point and adapter along the lower portion of the adapter. Accordingly, when the tooth point needs to be replaced, the shim must be driven out of the tooth point cavity, which becomes difficult if the material being excavated has become packed in against the shim.

A similar difficulty occurs in replacing the adapters for the tooth points and for replacing other wear prevention elements such as bucket wear plates and shrouds. For example, in U.S. Pat. No. 3,621,594, the adapters are secured to the bucket by a fluted wedge and spool arrangement wherein the wedge is driven to lock the adapter to the bucket. In practice, it is common to weld the wedge and spool together in order to prevent relative movement between the pieces so the weld must be broken or cut before the adapter can be removed. In U.S. Pat. No. 3,621,594, the adapters, protectors and tooth points are secured by retaining pins that are removably secured by split spring rings located in counterbores. Therefore, it is necessary to remove the material that is packed into the counterbores from the excavating operation before the split spring ring and retaining pins can be removed and the protectors, tooth points and adapters replaced.

Although it is the practice to replace the adapters for the teeth if they become worn, this is unnecessary if the tooth points are replaced before they are worn through by the abrasive material being excavated. The degree of wear that has occurred for each tooth point is difficult to determine, however. Further, the pattern of wear that occurs is different for each type of material being excavated and the pattern also differs according to the way in which the equipment is being operated. The reason it is difficult to determine the extent of wear of a tooth point is that the tooth point is usually designed to completely enclose the adapter so that wear on the adapter is prevented. Also, full metal to metal contact is usually required in order that a secure mounting arrangement is provided between the tooth point and adapter. Accordingly, an estimate of the amount of metal that remains before the tooth point will be worn through to the adapter is difficult unless the operator is familiar with the adapter shape and its relation to the tooth point in view of the extent of wear that has occurred to the tooth point at the time of inspection.

In view of the difficulties encountered in securely mounting wear prevention elements to the bucket of an excavation apparatus, little attention has been paid to protecting the interior of the bucket from being exposed to abrasion and wear and to preventing the broad flat bottom exterior portion of the bucket from being worn through. Of course, the extent of wear to these parts of the bucket is also smaller in relation to the wear that occurs at the lip of the bucket and this has contributed to the lack of consideration to preventing wear from occurring to these parts. Ordinarily, should a bucket wear problem occur along the bottom of the bucket or within the interior of the bucket, a patch is applied to the worn area by welding plate steel to the worn surface. Of course, this requires the availability of the plate metal for the patch and an experienced welder to perform the repair. Further, should the repair be needed on a curved portion of the bucket, an appropriately curved patch of plate steel needs to be fabricated in order to satisfactorily complete the patch. As excavating apparatus are ordinarily maintained in continuous use in the field, this type of patch work is difficult to perform unless the apparatus is hauled to an appropriate repair facility, which requires that the apparatus be taken out of service.

SUMMARY OF THE INVENTION

It is an object of the invention to overcome the problems encountered in the prior art wherein it is desirable to securely mount the wear prevention elements of an excavating apparatus to the bucket or scoop of the apparatus in a manner that withstands the loading pressures placed on these elements during excavating operations and yet allows for the quick and simple replacement of the elements without the need for experienced, skilled operators, including welders and without the need for special tools or skilled mechanics.

It is an object of the invention to securely mount a tooth point to an adapter without the need for a wedge while still maintaining substantial contact between the tooth point and adapter to prevent wear of the adapter and to ensure that the connection between the tooth point and adapter can sustain the high loading forces caused by excavating highly abrasive material or operating the bucket in a manner so as to cause strain in the tooth point and adapter assembly.

It is a further object of the invention to provide a tooth point and adapter assembly wherein the extent of wear of the tooth point in relation to the adapter can be determined by visually inspecting the tooth point without removing it from the adapter even though the tooth point substantially encloses the adapter in order to protect it from wear.

It is an object of the invention to provide a wear plate that protects the bottom of the bucket lip and that extends between adjacent tooth point-adapter assemblies, and that is securely mounted to the bucket lip by utilizing the secure connection provided between the tooth point-adapter assembly and the bucket.

It is an object of the invention to provide wear prevention elements for a bucket of an excavating apparatus that protect the outside corners, outer edges, planar bottom, and interior of the bucket, as well as the lip of the bucket by securely mounting the wear prevention elements in a manner that permits the elements to withstand the high loading forces placed thereon and allows for the replacement of the elements without the need for skilled operators or mechanics.

BRIEF DESCRIPTION OF THE DRAWINGS

FIG. 3 is a sectional view of the tooth point as assembled on the adapter;

FIG. 8 is a sectional view of the base plate with a shroud adapter and shroud mounted on the base plate according to FIG. 7;

FIG. 9 is a side view of a modification of the third embodiment of the invention showing a bucket having a bucket bottom wear plate and adapter mounted on the bucket;

FIG. 10 is a tooth point adapter wear plate for mounting on the tooth point adapters of FIG. 7; and FIG. 11 is a cross sectional view of the wear plate of FIG. 10 taken along line 11—11.

FIG. 12 is a partial front perspective view of a loader bucket according to a fourth embodiment of the invention having segmented liners mounted on the inside of the bucket.

FIG. 13 is a cross sectional view taken along line 13—13 of FIG. 12.

DETAILED MOUNTED DESCRIPTION OF THE PREFERRED EMBODIMENTS

Figure 1:
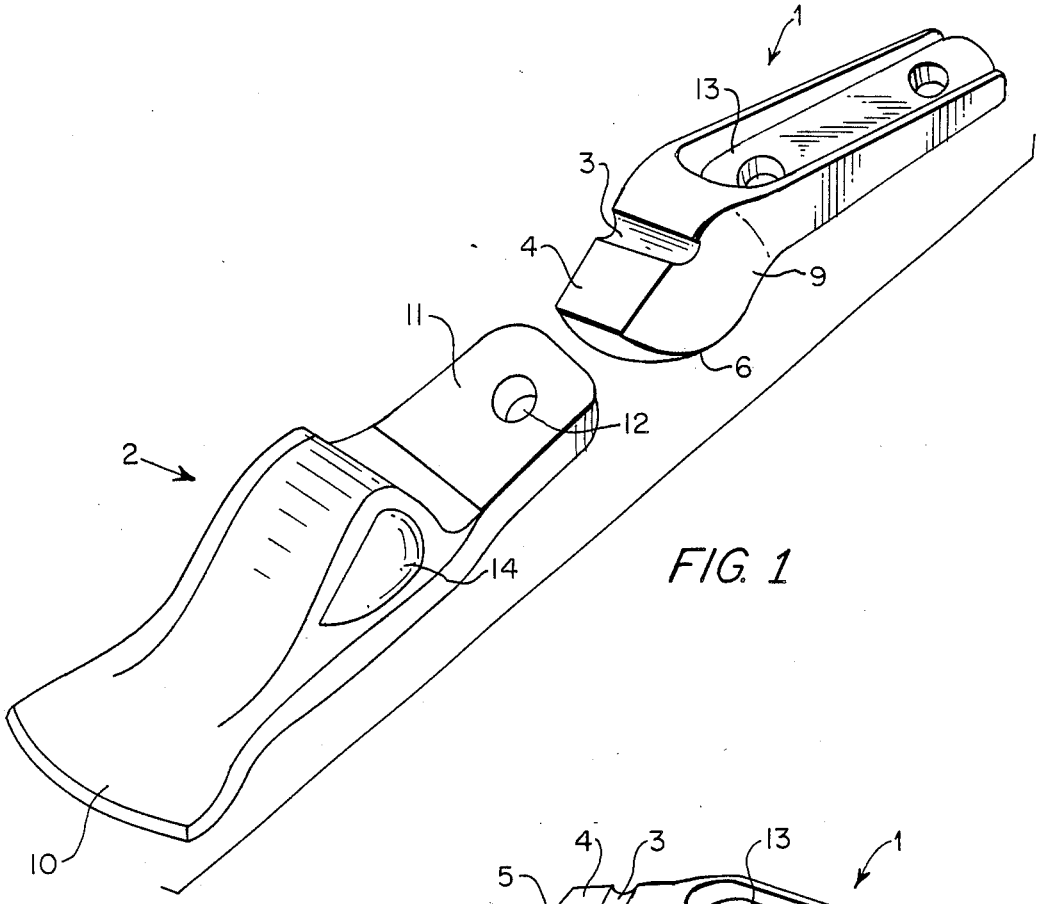
FIG. 1 is a front perspective view of a tooth point and adapter.
Figure 2:
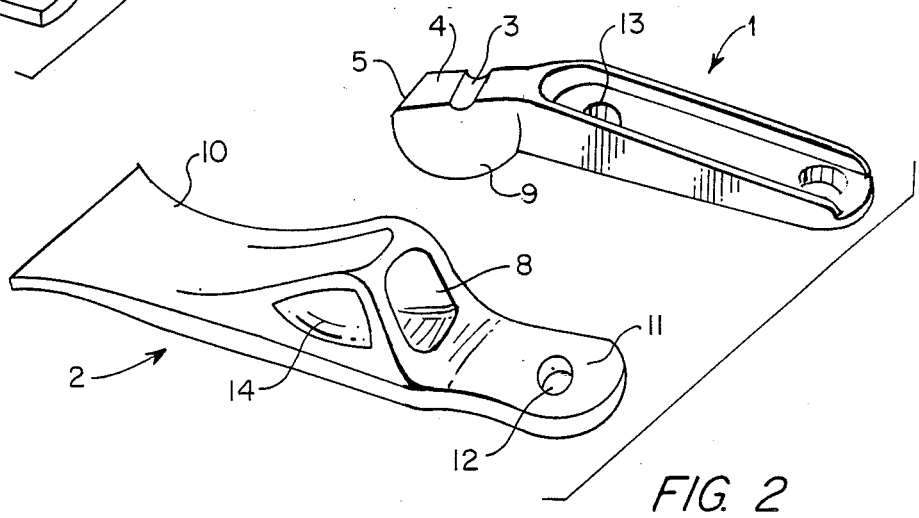
FIG. 2 is a rear perspective view of the tooth point and adapter of FIG. 1.

An adapter 1 as shown in FIGS. 1 and 2 consists of an elongated object usually several times in length as to width and height or thickness. Adapter 1 is usually made of cast or forged steel. Adapter 1 may be mounted on a bucket by bolting or welding it or through the use of wedges, or other types of fasteners in accordance with the design of the application.

The tooth point 2 is mounted to the adapter 1 after the adapter 1 is mounted on the equipment. The tooth point adapter 1 has a recessed area or groove 3. Recessed area 3 extends across the width of the adapter 1 along either the top or bottom thereof. Preferably, the recess 3 is circular, rounded or curved in shape and spans the width of the adapter 1 along its top surface 4. The top surface 4 of the adapter 1 may be flat, concave, convex or of an irregular shape. Surface 4 may or may not be in line with the center line of the adapter 1. The adapter also has a curved bottom wall 6, which is opposite from the recess 3, which tooth point 2 engages.

The tooth point 2 has a protruding surface 7 positioned within an enclosed cavity 8, as shown in FIG. 3. This protruding surface 7 is in the opposite form of the recess 3 of the adapter 1 and fits into the recess 3 of the adapter 1. The inner section or cavity 8 has a bottom cavity wall **8*a* that is curved to match bottom curved surface or wall 6 of the adapter. The tooth point 2 receives the adapter mounting portion or point 9 of the adapter 1 within cavity 8 such that bottom wall 6 engages the bottom wall 8*a* of the adapter when secured in place. To install the tooth point 2 in place on the adapter 1, the tooth point 2 (shown in dashed lines in FIG. 3) is on the adapter 1 with the center line of the tooth point 2 at an angle to the center line of the adapter 1. The protruding surface 7 of the tooth fits into the recessed segment 3 of the adapter 1 as the pointed end 10 of the tooth 2 is rotated downwardly to bring the center line of the tooth point 2 in line with the center line of the adapter 1. When installed on the adapter as shown in full lines in FIG. 3, the tooth point 2** is locked against movement in all directions except for against the rotational direction opposite to that traveled during installation.

As shown in FIG. 3, the bottom curved surface 6 of adapter point 9 includes arcuate portions that extend to each side of a bisector A that extends perpendicular from the outer bottom wall of the tooth point 2. Thus, the engagement between curved bottom wall 6 of the adaptor and the curved bottom wall **8*a*** of the tooth point prevents longitudinal movement parallel to the bottom of the tooth point while the bolted connection between the tooth point and adapter prevents rotational movement As a result, the shearing force applied to the bolt is reduced. Further, the tooth point is fully supported by the adapter in full metal to metal engagmement so that the connection can withstand the heavy loads applied to the tooth point.

For fully securing the tooth point onto the adapter, an extended area 11 of the tooth point is provided that has a hole 12. When the tooth point 2 is installed on the adapter, hole 12 is aligned with a hole 13 in the adapter to allow the adapter and tooth point to be bolted together. Thus, tooth point 2 is prevented from moving in the rotational direction opposite from which it is installed. The bolt may or may not pass through the blade or other structure used to secure the adapter, but is shown in FIG. 3 as passing through bucket blade 16. To remove the tooth point 2, the bolt is removed and the tooth point 2 is driven upwardly in the opposite direction from which it was installed. The point 10 or digging edge of the tooth 2 may be of various configurations, such as pointed, chiseled, flared, or of whatever form is advantageous for the application it is being used for.

According to another feature of the invention, the tooth point 2 is indented at 14 (or marked in another manner) on each side of the tooth point to indicate the outline of the cavity 8 (in which the adapter 1 fits). This allows visual inspection of the tooth point 2 to determine the degree of wear of the tooth point 2 in relation to the adapter 1. This allows the operator to replace the tooth point before damage occurs to the adapter. Also, the manufacturer can increase the wearing surface at various locations on the tooth point 2 in accordance with the pattern of wear that occurs so that a balanced pattern of wear can be achieved. In other words, the areas that receive maximum wear under certain conditions are built-up or made thicker so that the overall life expectancy of tooth point is increased.

Figure 4:
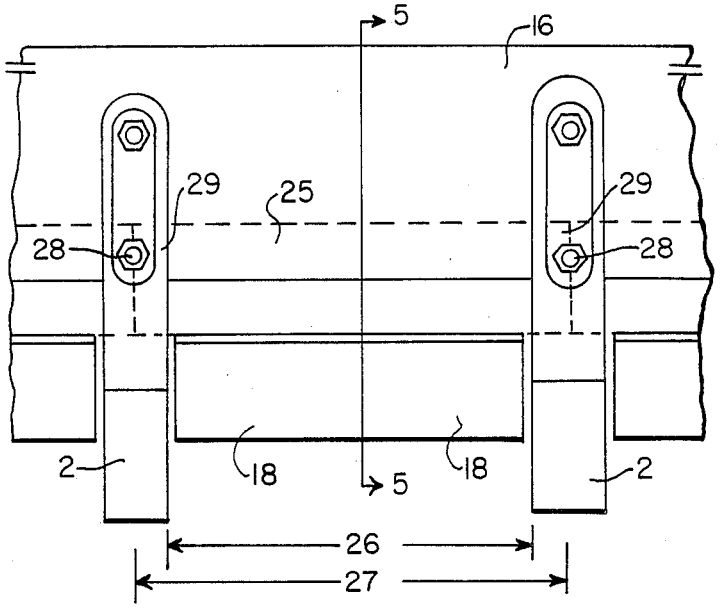
FIG. 4 is a partial top view of a second embodiment of the invention showing a bucket having two tooth points with adapters constructed according to a modification of the first embodiment, and a wear plate segment mounted on the blade between the adapter tooth points.
Figure 5:
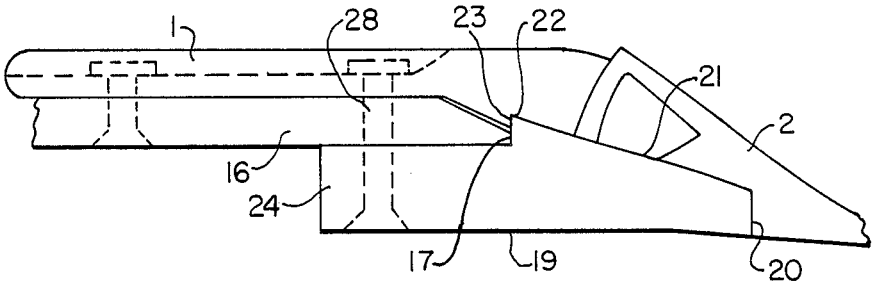
FIG. 5 is a sectional view of a tooth point-adapter and wear plate segment assembly taken along line 5—5 of FIG. 4.
Figure 6:
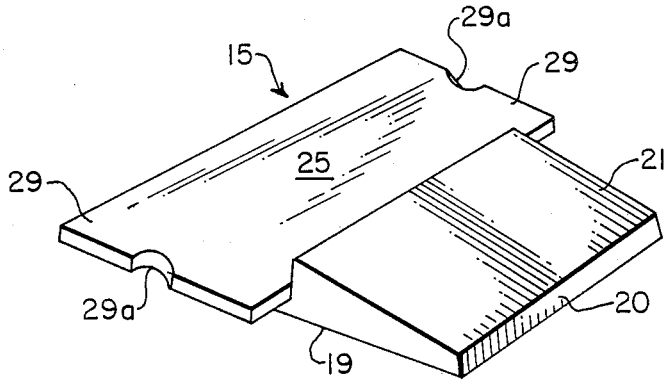
FIG. 6 is a perspective view of a wear plate segment as shown in FIG. 4.

The second embodiment of the invention is shown in FIGS. 4, 5 and 6. Segments 15 are secured between the tooth and adapter assemblies directly beneath and extending in front of a bucket blade 16. The function of the segments 15 is to prevent wear to the bucket blade bottom, blade leading edge 17, and the bottom of the extended area 11 of the tooth point. Using segments 15 is advantageous in that replacing them is less costly and time consuming than replacing the bucket blade 16.

As shown in FIG. 4, the area 18 of the segments 15 that absorbs the wear is in the form of an arrowhead blade sometimes referred to as a "double duty blade". The bottom side 19 of the segments 15 are flat for the full width of the segments. Preferably, the leading edge 20 of the segments 15 is perpendicular for approximately twenty percent of the total thickness of the segments 15 and is then sloped at 21 up towards the rear of the segment 15 at an angle, forming a wedge shape toward the maximum thickness portion 22. The distance of the top sloping surface 21 varies with different size segments but is usually one quarter to one third of the overall width of the segments. The adjoining area 23, to the rear of the sloping surface, is perpendicular to the bottom surface 19 for a distance of approximately one third of the maximum thickness, and then continues at a ninety degree angle from the vertical to the rear 24 of the segment 15, forming a flat surface 25 parallel to the bottom surface 19 for approximately two thirds of the total width. The segments 15 are uniform lengthwise, as described to this point, for a distance slightly less than the distance between two adjacent tooth points 26, when the teeth 2 are secured in place on the adapter 1 and bucket assembly.

The overall width 27 of the segments 15 equals the distance between the center of a bolt 28 that secures a tooth 2 in place to the center of an adjacent bolt 28 that secures the adjacent tooth 2 in place. The segment 15 has a flange 29 that steps up from the bottom surface 19 at the location where the tooth point's rear surface 11 extends, for slightly more than one half the width of the tooth point. Flanges 29 are preferably one half the thickness of adjacent portions of segments 15. Thus, a recessed area is formed between two different segments 15 that abut one another so that the extended section 11 of a tooth point fits within the recessed portion. Further, each flange 29 of a segment 15 has a one half bolt receiving cut-out portion **29*a* for the bolt 28 that is aligned with the hole in the blade 16, the hole 12 in the tooth point 2 and the hole 13 in the adapter 1. Accordingly, two adjacent tooth point and adapter assemblies and an interfitting segment 15 can be secured to the blade 16 with only one pair of securing bolts 28**.

The protruding sloping edge 21 of the segments 15, in length, equals the approximate distance 26 between adjacent tooth points 2. This configuration permits a segment to fit between adjacent teeth 2 with the bottom 19 and protruding forward edge 18 protecting the bottom and forward edge of the bucket blade 16 from wear. The bottom 19 of the segment 15 provides protection for the bottom of the extended portion 11 of the tooth point 2 from wear. When the forward bolt 28 in each tooth adapter 1 is removed, the tooth points 2 can be removed by rotating them in an upward radial direction. At the same time, segments 15 are unbolted and can be removed.

This embodiment and the other embodiments of this invention are not limited to loader buckets. The invention may be used on shovels, backhoes, hydraulic excavators, ditching machines and most any other machine that uses teeth to expedite the removal and loading of materials.

Figure 7:
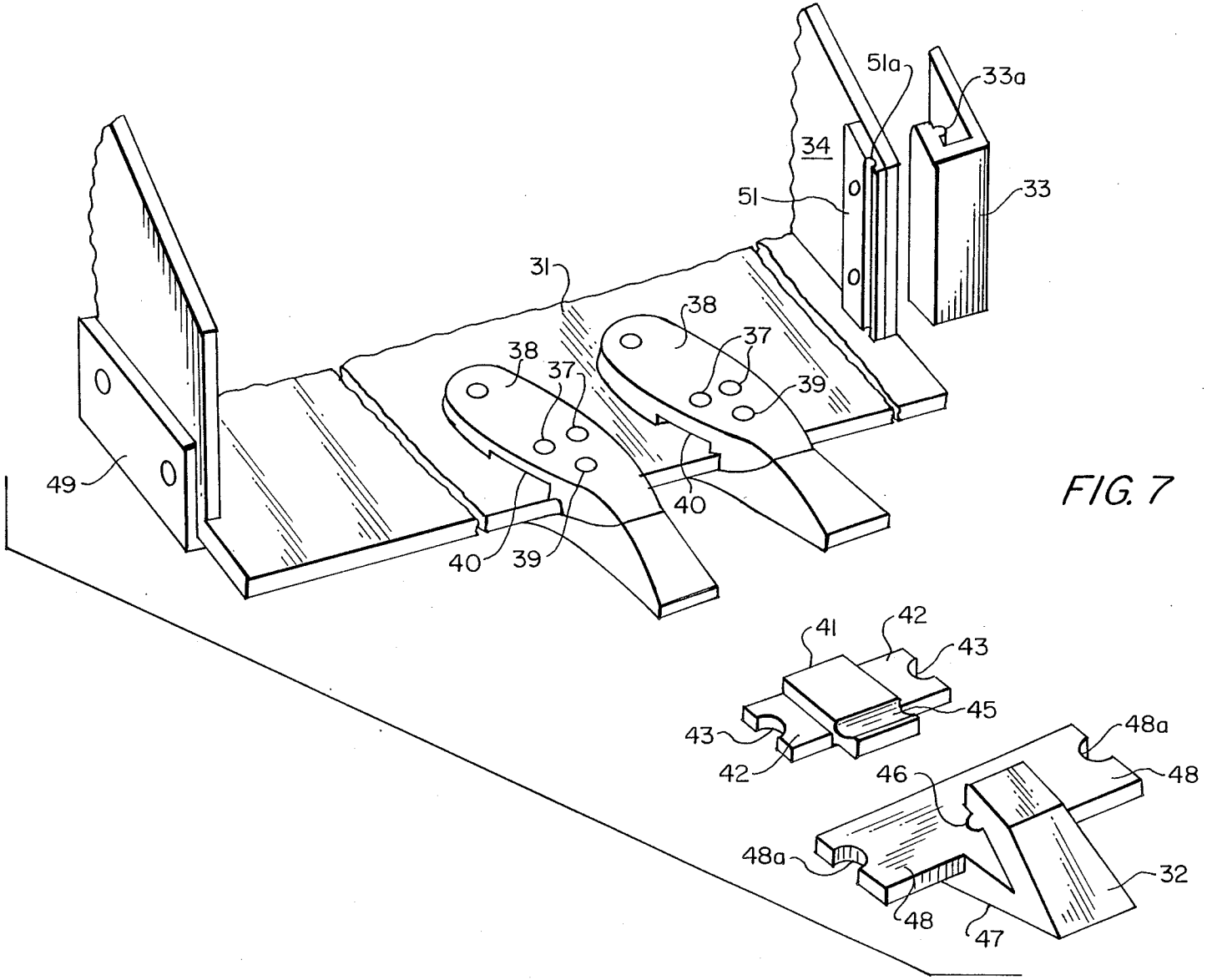
FIG. 7 is a partial perspective view of a third embodiment of the invention showing a modified bucket having a base plate with tooth points, tooth point adapters, a shroud adaptor plate and a shroud extending between the tooth points, a vertical corner shroud, and with a shroud on the bottom outer corner of the base plate.

In the third embodiment of the invention, the bucket blade is modified to include an integral adapter base plate 31 as shown in FIGS. 7, 8 and 9. The tooth points 2 and tooth point adapters 1 are shown as described in the first embodiment. Shrouds 32 extend between the teeth 2 and vertical corner shrouds 33 (only one being shown in FIG. 7) cover on the outer corners of the bucket. Wear plates 52, FIG. 9 are mounted on the bottom of the bucket. This embodiment is particularly preferred for applications where severe abrasive materials are to be removed, such as stone, iron ore, etc.

The integral adapter base plate 31 is mounted onto the bucket and extends the full width of the bucket perpendicular to ends 34, as shown in FIG. 7. The base plate is fixed, for example, by welding it onto the bucket ends and onto the bottom. Base plate 31 may be of the straight edge type or the spade lip type, (not shown, where the base plate is wider from front to back in the center than from front to back at the sides).

The integral adapter base plate 31 is preferably made of a high strength allow steel and may be cast, forged, or fabricated by any combination thereof. The base plate 31 is usually of even thickness throughout its flat bottom surface. The leading edge 35 is preferably tapered at an angle from the top of the plate to the tip 35' and then is curved or sloped backward to form a rounded portion, as shown in FIG. 8.

Base plate 31 has holes to accommodate bolts for securing the tooth point adapters 38 in place. The holes are spaced uniformly in alignment with the spacing of the plurality of teeth mounted across the front of the bucket. In describing this configuration there are four holes for bolts in each tooth point adapter 38, FIG. 7, with matching holes in the base plate, three at the outer section of the base plate 31 and one at the rear section of the base plate 31 for each tooth point adapter 38. The center hole 39 of the three outer holes is closest to the outer edge of the base plate 31. All four holes in the base plate 31 match the size and location of the four holes in each of the tooth point adapters 38. This embodiment of the invention is not limited to this bolt hole configuration, but rather the configuration is shown to better describe the invention.

The bottom of adapter 38 that comes in contact with the top of the base plate 31, when secured thereto, is relieved along the bottom side on both sides, as shown at 40 in FIG. 7. This is to allow the shroud adapter plate 41 to be secured in place between the two tooth point adapters 38 on the top side of the base plate 31. The shroud adapters 41 are essentially flat, extending from the outer top flat surface of the base plate 31 towards the rear of the base plate 31 in back of the outer relief areas 40. The shroud adapter plates 41 extend in length beyond adjacent adapters 38. The thickness of the shroud adapter plates 41 is uniform between adjoining tooth point adapters 38, but is diminished at the side portions 42 in alignment with the relieved areas 40 of the tooth point adapters 38. A one half bolt diameter cut out portion 43 is provided in each of side portions 42 that is aligned with the outer bolt holes 37 in the tooth point adapters 38 and the corresponding holes in the base plate 31. Each of the corresponding holes in the base plate 31 are countersunk at 44, FIG. 8, on the bottom side so that a bolt may be inserted with the bolt head being flush with the bottom surface of the base plate 31. The bolts are inserted through the base plate 31, the ends 42 of the shroud adapter plate 41 (through adjoining cut-out portions 43) and the outer holes 37 of the tooth point adapters 38 and secured with nuts.

The shroud adapter plate 41 has a groove 45, FIGS. 7 and 8, extending widthwise across the plate's outer top edge so that it extends between adjacent tooth point adapters 38. The inner top section of the shrouds 32 has a protruding surface 46, FIGS. 7 and 8, that fits into the matching groove 45 of the shroud adapter plates 41. When in place the shroud's inner surface matches the top sloping edge 35 the curved portion 36 at the front bottom edge of the base plate 31 and the outer bottom surface of the base plate 31. The outer surface of shroud 32 extends above the top of the adapter plates 41, in front of the base plate 31 and below the bottom of the base plate 31. The width of the shrouds 32 is slightly less than the distance between two adjoining teeth 2. The bottom section 47 of the shrouds 32 extends rearwardly of the front center bolt hole 39 of adapter 38. The bottom of the shrouds 32 are the of like configuration to the bottom of the segments 15 shown in the second embodiment. Flanges 48 extend outwardly from bottom section 47, each having a one half bolt diameter, cut out portion 48*a*.

To assemble the wear prevention elements and teeth, first the tooth point adapters 38, and shroud adapter plates 41 are placed on the base plate 31, with one bolt in each of the rear bolt holes of the base plate 31 and tooth point adapter 38. Then two bolts are placed through the outer bolt holes 37 so that the shroud adapter plates 41 and the tooth point adapters 38 are secured together. Next, the protruding surfaces 46 of each of the shrouds 32 are inserted in the top grooves 45, and moved down arcuately until the bottom 47 of the shrouds 32 are in place against the outer bottom of the base plate 31. The tooth points 2 are installed in like manner bringing the bottom of the extended portion 11 of the tooth points 2 in place to abut against the ends 48 of the shrouds 32. An outer center bolt is then inserted through the bottom of each of the tooth points 2, the ends 48 of the shrouds 32, the base plate 31 and the front center hole 39 in each of the tooth point adapters 38. Thereafter, the nuts are threaded onto the bolts for securing the tooth points 2, the shrouds 32, the base plate 31 and the adapters 38 in place. Accordingly, to remove the tooth points 2, and/or the shrouds 32 between the tooth point adapters 38, it is only necessary to remove one bolt from each tooth point assembly.

To protect the bottom of the bucket from wear, bucket bottom wear plates 52 are mounted to the bottom of the bucket. First, bucket bottom wear plate adapters 53 are attached to the bottom upper back of the bucket as shown in FIG. 9, in alignment with each of the tooth point adapters 38. The adapters 53 provide a fastening mechanism for attaching one end of the bucket bottom wear plates 52, to the bucket bottom. The bucket bottom wear plates 52 at one end onto the adapters 53 by a cooperating protrusion 52*a* and groove 53*a* structure in a manner similar to the structure that secures shrouds 32 in place on shroud adapter plates 41. The wear plates 52 extend from the back bottom of the bucket as shown in FIG. 9, to just in front of the back tooth adapter hole in the adapter base plate 31. The bottom wear plates 52 are attached to the adapter 53 and rotated into position on the bottom of the bucket, FIG. 9. A bolt is inserted through a hole 54 in the bottom wear plate 52, through the rear hole in the base plate 31 and the rear hole in the tooth adapter 38. When the nut is secured on the bolt, the wear plate 52 will be secured in place. It is only necessary to install or remove one bolt in each wear plate 52 to install or remove each bucket bottom wear plate 52.

The bottom outer corners of the bucket have shrouds 49 in the form of an angle iron for protecting the corners of the bucket from wear (only one being shown in FIG. 7 for clarity). The shrouds 49 extend under the bottom outer corners and up along the outer bottom sides of the integral adapter base plate 31 so that the holes shown respectively in FIG. 7 would be aligned. The corner shrouds 49 are secured in place with four or more bolts, two from the bottom side up through the shroud 49 (not shown), including through the integral adapter base plate 31 and two through the rear and outer front holes of a corner tooth point adapter (not shown). There are two bolt holes through the side of the shroud 49. In some buckets there are additional holes in each rear side of the shroud 49 and through the side and bottom of the bucket. In all corner shrouds 49 of this invention, the bolt hole locations in the side and bottom of the corner shrouds 49 are of the same configuration. This makes these corner bottom shrouds 49 interchangeable with each other. Each shroud 49 may be positioned so the front bottom portion on one end will become the rear bottom end portion on the opposite end of the bucket, or so that the left side may be positioned on the right bottom of the other end. The front bottom of these shrouds 49 normally wears the fastest and it is advantageous that they may be positioned in four different ways so as to receive the maximum wear from each side.

Shrouds 33, FIG. 7, are provided on the two vertical front ends of the integral adapter base plate 31, only one being shown for clarity, for additional wear protection.

Shrouds 33 consist of a flat adapter plate 51 that bolts to the inside of the vertical end 34 of the bucket. The corner shrouds 33 lock into plates 51 by a cooperating protrusion 33*a* and groove structure 51*a*, and surround the outer vertical edge 34 of the bucket. Both adapter plate 51 and shroud 33 is fastened on the vertical sides of the bucket or base plate 31 through only two holes in the adapter plates 51 and aligned holes in shrouds 33. The left vertical shroud may be positioned on the right vertical corner and in this change of position, the top edge of the right shroud becomes the bottom edge of the left shroud, extending the wear life of both vertical corner shrouds 33.

Optional wear plates shown in FIGS. 10 and 11 protect the top and sides of the tooth point adapters 38. They are in the form of the adapter 38 top and side surfaces, fitting over the tooth point adapters 38 and secured in place with the rear bolt and the two front outer bolts. These wear plates have protruding surfaces 55 surrounding the nuts at all four bolt locations of the tooth point adapter 38. In all embodiments, the location of the bolt heads and the nuts on the bolts may be in a recessed area or the metal surrounding the head or nut may be raised or in the form of a doughnut to protect the bolt head or nut from wear. In this regard, it is preferable that the protruding surfaces 55 are of a sufficient diameter to permit clearance for a socket or wrench to engage the nut being protected, as shown in FIG. 11. It is understood that any part of any embodiment may be integrated into any other embodiment where advantageous.

The protrusion 7 of the tooth point secures the tooth point to the adapter by engagement of the protrusion within the recess 3 of the adapter. In a similar way, protruding surface 46 engages groove 45 to secure shroud 32 to shroud adapter plate 41. A protrusion 33*a* of corner shroud 33 is provided to engage a groove 51*a* of an adapter plate 51. Also, a cooperating protrusion in groove structure to secure on end of bottom ware plate 52 to adapter 53, as shown in FIG. 9. For each of these pairs of wear prevention elements, the protrusion is provided on one side to provide a locking engagement between the parts on that side and on the opposite side the parts are bolted together. For example, in FIG. 1, the protrusion 7 of the tooth point is provided to extend in groove 3 of the top surface 4 of the adapter while the bottom extended surface 11 of the tooth point is through bolted from the other side of the adapter. As shown in FIG. 7, this relationship holds true for the cooperating recess and groove structure of the shrouds 32 and shroud adapter plates 41 as well as the vertical corner shrouds 33 and shroud adapter plates 51. Again, in FIG. 9, the protrusion 52*a* engages groove 53*a* on one side of adapter element 53 while the opposite side of wear plate 52 is secured to the bottom of the bucket. For each of these paired wear prevention elements, the combination of the protrusion and groove on one side and the bolted connection on the other side allows the minimum number of bolts for securing the wear prevention elements to the bucket structure of the excavation apparatus.

The cooperating groove and recess structure provided for the many wear prevention elements also provides an advantage of allowing full metal to metal engagement between the adapter and wear prevention elements. Each of the wear prevention elements must encompass or encircle an adapter or structure of the bucket in order to protect it. This requires that the wear prevention element have a U-shaped characteristic, best seen in FIG. 7 with respect to corner shrouds 33. If through bolts are used to secure a U-shaped structure to the bucket blade or bucket corner, then the bolts cannot be tightened to secure the wear prevention element to the blade structure unless the internal dimensions of the U-shaped wear prevention element closely match that of the structure that it is being secured to. This problem is prevented by the groove and recess structure according to the present invention, because of the relative pivoting movement allowed by the groove and recess structure joint. Accordingly, through bolts can be used to secure the adapter plate and wear prevention element to each other and to the bucket structure being protected.

The fourth embodiment is shown in FIG. 12 and includes quick change segmented liners for inside bucket wear protection. Liners 56 and 57 fit inside of the loader bucket. This embodiment further includes end liners 58 that are of the same configuration as the inside of the end plates 34 of the bucket. These end liners 58 are secured in place with, and at the same time as, the bottom outer corner shrouds 49 of FIG. 7, and the vertical front end shrouds 33 and 51, not shown in FIG. 12. They also extend to the outer surface of the inside bottom and back inside of the bucket and are overlapped along the bottom edge by the quick change segmented inside liners 57. The bucket end liners 58 are interchangeable from left to right and right to left. The quick change segmented inner bucket liners 56 and 57 are approximately one half the width of the distance between the teeth and extend from in back of the shroud adapter 41 that is secured between the tooth adapters to near the top inside back of the bucket 61. The segmented inside bucket liners 56 and 57 may vary in thickness to compensate for the locations inside of the bucket that are subject to the most wear.

The segmented liners 56 and 57 are of two types. One type 56 fits between the tooth adapters, and the other type 57 fits under the rear section 62 of the tooth adapter 1. The type 56 fitting between the adapters has stepped outer edges or flanges 63 that contact the inner surface of the bucket. Segmented liner 57 that fits under the back end 62 of the tooth adapter 1 has stepped outer edges or flanges 63' that are of reverse orientation so that they overlie the edges 63 of the in-between segments 56. All segmented liners are secured in place at their upper end 61 at the back of the bucket location with clips, which can be bars 64 of metal welded or otherwise secured to the upper inside back of the bucket, with a relief section 65 of the bar fitting over the top of the segments 56 and 57. The clips prevent the segments 56 and 57 from moving away from the inner surface of the bucket and from moving back towards the upper back top edge of the bucket. The ends of the segmented liners 56 closest to the blade edge 67 of the bucket that fit between the tooth adapters 1 abut against the back edge of the shroud adapter plate 41 (not shown in FIG. 12) and are prevented from moving away from the bottom of the bucket by the overlapping segment liners 57 that fit under the rear section 62 of the tooth point adapter 1. The rear bolt of the tooth point adapter 1 constructed according to the first embodiment, for example, fits through the bottom of the integral adapter base plate 31 and the overlapping segmented liners 57. When the nut is secured on this bolt, the segmented liners 56 and 57 are secured in place. (As previously disclosed, the bucket bottom wear plates 52 and the tooth point adapter wear plates, FIG. 11, are also secured in part with the tooth point rear adapter bolt.)

The segmented liners 56 and 57 may be made from various abrasive resistant metals or from synthetics, such as polyurethane. When the segments 56 and 57 are made from materials with sufficient flexibility, they are reversible from end to end, thus providing a wearing surface that may be repositioned after being worn to its useful life in the one position.

Segmented liners 56, 57 and 58 provide a bucket liner that has the advantage of being installed or removed in a minimum length of time while allowing maximum wear life. To remove or reverse the segmented liners 56 and 57, it is only necessary to remove one tooth point adapter 1 and one rear tooth point adapter bolt from the remaining tooth point adapters 1. After the one tooth point adapter 1 is removed, the end of the segment 57 that was secured beneath rear section 62 of the adapter 1 is lifted up. Then, the segment 57 is moved towards the tooth point 2 edge of the bucket out from under the metal bar 64, completely freeing the segment from its secured location. Next, the adjacent segment 56 can be moved towards the opening left by the removed segment 57 and so that it may be removed in the same manner. This procedure can be continued until all of the segments 56 and 57 are removed and then the segments can be reversed end for end, (or replaced with new segments).

Although the invention has been described with reference to several embodiments, the invention may be practiced according to the foregoing teachings by making modifications to the embodiments without departing from the scope of the invention. Accordingly, the invention is defined by the following claims.

I claim:

1. A tooth point and adapter assembly for a bucket of an excavation apparatus, comprising:

said adapter having a body having opposite ends, wherein one of said ends is fixed to said bucket, and the other of said ends has a mounting portion;

said mounting portion having a top surface and a bottom curved surface;

said tooth point having a body and an adapter engaging portion having an enclosed cavity for receiving said mounting portion between opposite ends wherein one of said ends has a digging tooth;

means for securing said tooth point to said adapter including said top surface of said adapter mounting portion having a recess and said adapter engaging portion of said tooth point having a protrusion located wholly within said cavity and shaped to be received in said recess so that a joint is formed between said recess and said protrusion that is enclosed within said cavity, and said cavity further having a curved bottom portion shaped to engage said bottom curved surface of said adapter whereby said adapter mounting portion is inserted in said tooth point cavity and said tooth point is rotated relative to said adapter to seat said protrusion in said recess and further to establish said engagement between said curved surface of said adapter and said curved bottom portion of said cavity.

2. A tooth point and adapter assembly as claimed in claim 1, wherein said tooth point further includes means for fixing the other of said ends to one of said bucket and said adapter such that relative movement between said tooth point and said adapter is prevented.

3. A tooth point and adapter assembly according to claim 2, wherein said adapter has at least one through hole for bolting said adapter to said bucket, and further wherein said tooth point has one through hole at said other end that is aligned with said at least one through hole of said adapter when said protrusion of said tooth point is fully seated within the recess of said adapter such that said adapter and said tooth point are secured to each other and to said bucket with a common bolt and nut.

4. A tooth point and adapter assembly according to claim 1, further comprising:

said means for securing further including said recess being semi-circular groove extending laterally across a width of said top surface of said adapter mounting portion and said bottom curved surface of said adapter mounting portion having a curve that is an arc of a fixed radius having an origin at said recess; and said curved bottom portion of said tooth point cavity having a curve matching the curve of said bottom curved surface of said adapter mounting portion such that said tooth point is rotated about a point of engagement between said protrusion and said recess with said bottom curved bottom portion of said cavity and said bottom curved surface of said adapted mounting portion in substantially full contact.

5. A tooth point and adapter assembly according to claim 4, wherein said protrusion of said tooth point adapter engaging portion extends laterally across a full width of said tooth point, said protrusion having the shape of a portion of a cylinder for seating within said semicircular recess groove.

6. A tooth point and adapter assembly according to claim 1, wherein said adapter engaging portion of said tooth point further includes said cavity portion having a top interior wall and a bottom interior wall constituting said curved cavity bottom portion and said protrusion extends laterally along said top interior wall, and said cavity portion further has flat interior side walls and corresponding cavity exterior side walls, said exterior side walls having means for indicating at least one of the dimensions of said cavity, whereby when said tooth point is secured to said adapter, said mounting portion of said adapter fills said cavity such that as said tooth point is worn down, said indicating means enables one to determine the extent of wear of said tooth point cavity portion in relation to said adapter.

7. A tooth point and adapter assembly according to claim 1, wherein said protrusion is positioned along a top interior wall of said cavity portion between opposite ends of said top interior wall such that approximately 30 degrees of relative rotation between said tooth point and said adapter allows said protrusion of said tooth point to be disengaged from said recess such that said tooth point can be removed from said adapter.

8. A tooth point and adapter assembly according to claim 1, wherein said tooth point cavity portion has a top wall having opposite ends and extending from said curved cavity bottom portion at one of said ends to an opening of said cavity portion at the other of said ends, said protrusion located between said ends and extending across said top wall and said other end acting as a fulcrum about which said tooth point is rotated prior to said protrusion being seated within said recess such that said tooth point is first rotated about said fulcrum to partially seat said protrusion within said recess and then rotated further with said curved surface of said adapter mounting portion and said curved cavity bottom portion being in sliding contact to a fully engaged position wherein said protrusion is fully seated within said recess and said mounting portion curved surface fully engages said curved cavity bottom portion.

9. A tooth point and adapter assembly according to claim 8, wherein said tooth point further includes means for fixing the other of said ends to one of said bucket and said adapter such that relative rotation between said tooth point and adapter is prevented and said tooth point and adapter are secured to one another.

10. A tooth point and adapter assembly according to claim 1, wherein said tooth point has an outer bottom wall and said curved surface of said adapter is arcuate and extends to both sides of a bisector extending perpendicular from said outer bottom wall of said tooth point and said curved cavity bottom portion being shaped to receive each of said arcuate portions extending on both sides of said perpendicular bisector of said adapter mounting portion curved surface such that engagement of said protrusion in said recess and contact between said curved cavity bottom portion of said tooth point and said bottom curved surface of said adapter mounting portion when said tooth point and said adapter are assembled together prevents movement in directions parallel to said outer bottom wall of said tooth point.

11. A wear prevention assembly for a bucket of an excavation apparatus having a plurality of tooth points secured to tooth point adapters mounted along the blade of the bucket, comprising:

said adapter having a body having opposite ends, wherein one of said ends is fixed to said bucket, and the other of said ends has a mounting portion having a top surface and a bottom curved surface;

said tooth point having a body and an adapter engaging portion having an enclosed cavity portion for receiving said mounting portion between opposite ends, wherein one of said ends has a digging tooth;

means for securing said tooth point to said adapter including said top surface of said adapter mounting portion having a recess and said adapter engaging portion of said tooth point having a protrusion located wholly within said cavity and shaped to be received in said recess so that a joint is formed between said protrusion and said recess that is enclosed within said cavity, and said cavity further having a curved bottom portion shaped to engage said bottom curved surface of said adapter whereby said adapter mounting portion is inserted in said tooth point cavity and rotated relative to said adapter to seat said protrusion in said recess and further to establish said engagement between said curved surface of said adapter and said curved bottom portion of said cavity;

segment means extending between adjacent ones of said adapter and tooth point assemblies for protecting a front blade edge of said bucket between said tooth points, said segment means having a tapered front edge at one end thereof and means for securing said segment to said adapter and said bucket at the other end thereof, and an undercut portion between said ends for receiving the blade edge of said bucket;

said tooth points further including means for fixing the other of said ends to one of said bucket and said adapter such that relative movement between said tooth point and said adapter is prevented; and said segment means being secured to one of said adapter and said bucket by said means for fixing said tooth point.

12. A wear prevention assembly according to claim 11, wherein said means for fixing said tooth point includes aligned through holes extending through each of said bucket, said adapter, and said tooth point for receiving a threaded bolt and nut, and said segment means having flanges of a reduced thickness adapted to extend between one half of said other end of each of said tooth points between which said segment means extends and said bucket, and said flanges each having one half diameter cut-out portions aligned with the through holes such that a plurality of said segment means abut one another across an edge of said bucket with said cut-out portions facing one another in alignment with the through holes to receive said threaded bolt and nut for fixing said tooth point, adapter and segment means to one another and to said bucket.

13. A wear prevention assembly for a bucket of an excavation apparatus having a plurality of tooth point and adapter assemblies mounted across a front edge of the bucket, comprising:

said bucket having an adapter base plate fixed along the front edge of the bucket;

said adapters each having a body having opposite ends, wherein one of said ends is fixed to said bucket and the other of said ends has a mounting portion having a top surface and a bottom curved surface;

said tooth points each having a body and an adapter engaging cavity portion between opposite ends, wherein one of said ends has a digging tooth;

means for securing said tooth point to said adapter including said top surface of said adapter having a recess and said adapter engaging portion of said tooth point having a protrusion shaped to be received in said recess, and said tooth point having a curved bottom portion of said cavity portion shaped to engage said bottom curved surface whereby said adapter mounting portion is inserted in said tooth point cavity and said tooth point is rotated relative to said adapter to seat said protrusion in said recess and further to establish contact between said curved surface of said adapter and said curved cavity bottom portion of said tooth point;

a plurality of shrouds and shroud adapter plates extending between said tooth point and adapter assemblies;

said shroud adapter plates each having flange portions adapted to underlie a portion of each of said adapters that said shroud adapter plate extends between, and a groove extending along a front edge portion of said shroud adapter plate;

each of said shrouds having a wedge shape including a top wall for overlying said base plate and a bottom wall for underlying said base plate, said top wall having a protrusion for being seated within said groove of said shroud adapter plate and said shroud having outer flange portions underlying the other of said ends of said tooth points;

first means for fixing the other of said ends of said tooth points to said adapters, said shroud adapter plates, and said bucket; and second means for fixing said shrouds through said shroud outer flanges to said adapters such that said shroud outer flanges underlying said base plate and cover said first fixing means to prevent wear of said first fixing means.

14. The wear prevention assembly according to claim 13, further comprising:

bucket bottom wear plates and means for securing the bucket bottom wear plates to the bottom of the bucket in side by side relationship to cover the bottom of the bucket including bucket bottom wear plate adapters mounted on the bucket opposite the front edge of the bucket, each said adapter having a groove and each said bucket bottom wear plate having opposite ends including a projection at one end for fitting within said groove and means for securing the other of said ends to the bucket;

said bucket bottom wear plates having a substantially planar midportion and a curved portion at said one end, said bucket bottom wear plate adapters each having a bottom curved portion shaped to receive the curved portion of said one end of the bucket bottom wear plates so that said protrusion of said bucket bottom wear plates fits within said groove of said bucket bottom wear plate adapter and said other end is fixed to the bucket for securing the bucket bottom wear plates to the bottom of the bucket.

15. A wear prevention assembly according to claim 13, wherein said first fixing means includes aligned through holes extending through said adapter, said shroud adapted plate and base plate for receiving a threaded bolt and nut, wherein said flange portions of said shroud adapter plates have cut-out portions of one half diameter of the through holes so that abutting ones of said shroud adapter plates have facing cut-out portions that are aligned with the through holes to receive the threaded bolt and nut for securing the shroud adapter plates, adapters and base plates together;

said second fixing means including aligned through holes through said adapter, tooth point and base plate wherein said flange portions of said shrouds have cut-out portions of one half diameter of the through holes so that abutting ones of said shrouds have facing cut-out portions that are aligned with the through holes to receive a threaded bolt and nut fastener.

16. A wear prevention assembly according to claim 15, further including a plurality of wear plates each adapted to cover a corresponding one of said adapters to prevent wear to the top surface of said adapter, including means for bolting said adapter wear plates to said adapters.

17. A wear prevention assembly according to claim 13, further comprising:

bucket interior liner segments and means for mounting the bucket interior liner segments to the interior of the bucket, including clips for mounting one end of each of said liner segments to the inside of the bucket and means aligned with said tooth point fixing means for securing the other end of said liners to the bucket; and said segment liners having interfitting means along each abutting edge portion for interfitting each said segment liner with an adjoining said segment liner.

18. A wear prevention assembly according to claim 17, wherein said interfitting means includes complimentary facing stepped edge flanges positioned along each edge of said adjoining segment liner.

19. A wear prevention assembly according to claim 13, further including corner shrouds and corner shroud adapter plates, wherein said corner shrouds have a curved portion for extending over an edge of the bucket and said corner shroud adapter plate has a groove for receiving a protrusion extending along said corner shroud such that said corner shroud is interlocked with said corner shroud adapter plate by engagement of said protrusion in said groove and fixed to the bucket along the other end of said corner shroud by fixing means including through holes extending through said corner shroud adapter plate, bucket edge and corner shroud so that a common threaded bolt and fastener secures said corner shroud adapter plate and said corner shroud to the bucket through said through holes.

20. A tooth point and adapter assembly for a bucket of an excavation apparatus, comprising:

said adapter having a body having opposite ends, wherein one of said ends is fixed to said bucket, and the other of said ends has a mounting portion;

said mounting portion having a top surface and a bottom curved surface;

said tooth point having a body and an adapter engaging portion having an enclosed cavity for receiving said mounting portion between opposite ends wherein one of said ends has a digging tooth;

means for securing said tooth point to said adapter including said top surface of said adapter mounting portion having a recess and said adapter engaging portion of said tooth point having a protrusion located wholly within said cavity and shaped to be received in said recess so that a joint is formed between said recess and said protrusion that is enclosed within said cavity, and said cavity further having a curved bottom portion shaped to engage said bottom curved surface of said adapter whereby said adapter mounting portion is inserted in said tooth point cavity and said tooth point is rotated relative to said adapter to seat said protrusion in said recess and further to establish said engagement between said curved surface of said adapter and said curved bottom portion of said cavity; and said tooth point cavity portion having outer sides, and said outer sides having means for visually indicating the position of said adapter mounting portion in relation to said tooth point such that the extent of wear of said tooth point in relation to said adapter can be determined when said tooth point and adapter are in an assembled position.

21. A tooth point and adapter assembly according to claim 20, wherein said indicating means includes said mounting portion of said adapter having a side profile and at least one of said outer sides having a recess corresponding to said side profile of said mounting portion.

* * * * *